US009004954B2

(12) United States Patent
Baldwin et al.

(10) Patent No.: US 9,004,954 B2
(45) Date of Patent: Apr. 14, 2015

(54) ELECTRICAL CONNECTION SYSTEM

(71) Applicant: Delphi Technologies, Inc., Troy, MI (US)

(72) Inventors: Ronald A. Baldwin, Cortland, OH (US); Christopher Adrian Margrave, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 120 days.

(21) Appl. No.: 13/749,967

(22) Filed: Jan. 25, 2013

(65) Prior Publication Data

US 2013/0252474 A1 Sep. 26, 2013

Related U.S. Application Data

(60) Provisional application No. 61/613,803, filed on Mar. 21, 2012.

(51) Int. Cl.

| | |
|---|---|
| ***H01R 13/64*** | (2006.01) |
| ***H01R 13/46*** | (2006.01) |
| ***H01R 13/645*** | (2006.01) |
| ***H01R 13/44*** | (2006.01) |
| *H01R 13/629* | (2006.01) |

(52) U.S. Cl.

CPC ..... *H01R 13/46* (2013.01); *H01R 13/6456* (2013.01); *H01R 13/44* (2013.01); *H01R 13/629* (2013.01)

(58) Field of Classification Search

USPC ..... 439/660, 674, 677, 680, 948

See application file for complete search history.

(56) References Cited

U.S. PATENT DOCUMENTS

| | | | | | |
|---|---|---|---|---|---|
| 3,742,424 | A | * | 6/1973 | Startin | 439/678 |
| 4,455,056 | A | * | 6/1984 | Herrmann et al. | 439/347 |
| 4,818,237 | A | | 4/1989 | Weber | |
| 5,455,515 | A | * | 10/1995 | Saijo et al. | 324/538 |
| 5,662,500 | A | * | 9/1997 | Yeah | 439/732 |
| 5,667,393 | A | * | 9/1997 | Grabbe et al. | 600/443 |
| 5,769,648 | A | * | 6/1998 | Hayashi | 439/206 |
| 6,273,736 | B1 | | 8/2001 | Taylor et al. | |
| 6,790,067 | B2 | * | 9/2004 | Douty et al. | 439/284 |
| 7,086,872 | B2 | * | 8/2006 | Myer et al. | 439/78 |
| 7,597,573 | B2 | * | 10/2009 | Defibaugh et al. | 439/206 |
| 7,789,714 | B2 | * | 9/2010 | Liu | 439/682 |
| 8,182,296 | B2 | * | 5/2012 | De Blieck et al. | 439/680 |

(Continued)

FOREIGN PATENT DOCUMENTS

| | | | |
|---|---|---|---|
| DE | 102008019764 | A1 | 10/2009 |
| EP | 2418742 | A1 | 2/2012 |

OTHER PUBLICATIONS

European Search Report dated May 3, 2013.

*Primary Examiner* — Neil Abrams
*Assistant Examiner* — Travis Chambers
(74) *Attorney, Agent, or Firm* — Thomas N. Twomey

(57) ABSTRACT

An electrical connection assembly includes a first connector which includes a first electrical contact surrounded by a first connector wall defining a first connector cavity. The first connector wall includes a plurality of ribs extending into the first connector cavity. A second connector is matable with the first connector along a mating axis and includes a second electrical contact in electrical communication with the first electrical contact when the first connector is mated with the second connector. The second connector includes a second connector body surrounding the second electrical contact.

13 Claims, 7 Drawing Sheets

(56) References Cited

U.S. PATENT DOCUMENTS

| | | | | |
|---|---|---|---|---|
| 8,292,673 | B2 * | 10/2012 | Zhu | 439/660 |
| 8,298,022 | B2 * | 10/2012 | Tsuruta et al. | 439/886 |
| 8,545,275 | B2 * | 10/2013 | Wang et al. | 439/693 |
| 8,574,015 | B2 * | 11/2013 | Tai et al. | 439/682 |
| 8,727,813 | B2 * | 5/2014 | Yang et al. | 439/682 |
| 8,821,184 | B2 * | 9/2014 | Yu et al. | 439/512 |
| 2004/0115980 | A1 | 6/2004 | Douty et al. | |
| 2008/0207029 | A1 * | 8/2008 | Defibaugh et al. | 439/206 |
| 2012/0178309 | A1 * | 7/2012 | De Blieck et al. | 439/680 |

* cited by examiner

ELECTRICAL CONNECTION SYSTEM

CROSS-REFERENCE TO RELATED APPLICATIONS

This patent application claims the benefit of U.S. provisional patent application Ser. No. 61/613,803 filed Mar. 21, 2012, the disclosure of which is hereby incorporated by reference in its entirety.

TECHNICAL FIELD OF INVENTION

The present invention relates to an electrical connection system; and more particularly to an electrical connection system which prevents a finger of a user from coming into contact with an electrical terminal of the electrical connection system.

BACKGROUND OF INVENTION

There are applications where a high-voltage, high-current, large device connection system may require a finger test probe certification that indicates that a test probe, when inserted into a section of a connector half of the device connection system, is prevented from making electrical contact with an electrical terminal disposed therein. The finger test certification is desired so that, for example, if the connection system is employed in an electric or hybrid electric vehicle, a human operator's finger, if making contact with connection system, does not make contact with the electrical contact of the device connection system.

One related connection system is a complex, moving part connection system 100, as shown in FIGS. 1 and 2. Connection system 100 generally includes a first connector half 102 having a first electrical terminal 104 and a second connector half 106 having a second electrical terminal 108. First connector half 102 employs a protective piece 110 that is moveable between a protective position as shown in FIG. 1 when the first connector half 102 is not mated with second connector half 106 to a non-interfering position as shown in FIG. 2 when first connector half 102 is mated with second connector half 106. As shown in FIG. 1, protective piece 110 is locked in the protective position when first connector half 102 is not mated with second connector half 106. Thus, protective piece 110 prevents a finger of a user from coming into contact with first electrical terminal 104. As shown in FIG. 2, mating of first connector half 102 with second connector half 106 unlocks protective piece 110 from the protective position and allows protective piece 110 to move upward into the non-interfering position. Movement of protective piece 110 upward allows first electrical terminal 104 to make electrical contact with second electrical terminal 108. Conversely, when first connector half 102 is unmated from second connector half 106, protective piece 110 moves downward and locks into the protective position. Connection system 100 is tightly toleranced in order to allow protective piece 110 to move between the protective position and the non-interfering position. The tight tolerances required of connection system 100 may lead to increased manufacturing costs.

What is needed is an electrical connection system which minimizes or eliminates one or more of the shortcomings as set forth above.

SUMMARY OF THE INVENTION

Briefly described, an electrical connection assembly is provided which includes a first connector which includes a first electrical contact surrounded by a first connector wall defining a first connector cavity. The first connector wall includes a plurality of ribs extending into the first connector cavity. A second connector is matable with the first connector along a mating axis and includes a second electrical contact in electrical communication with the first electrical contact when the first connector is mated with the second connector. The second connector includes a second connector body surrounding the second electrical contact.

BRIEF DESCRIPTION OF DRAWINGS

This invention will be further described with reference to the accompanying drawings in which.

DETAILED DESCRIPTION OF INVENTION

Figure 1:
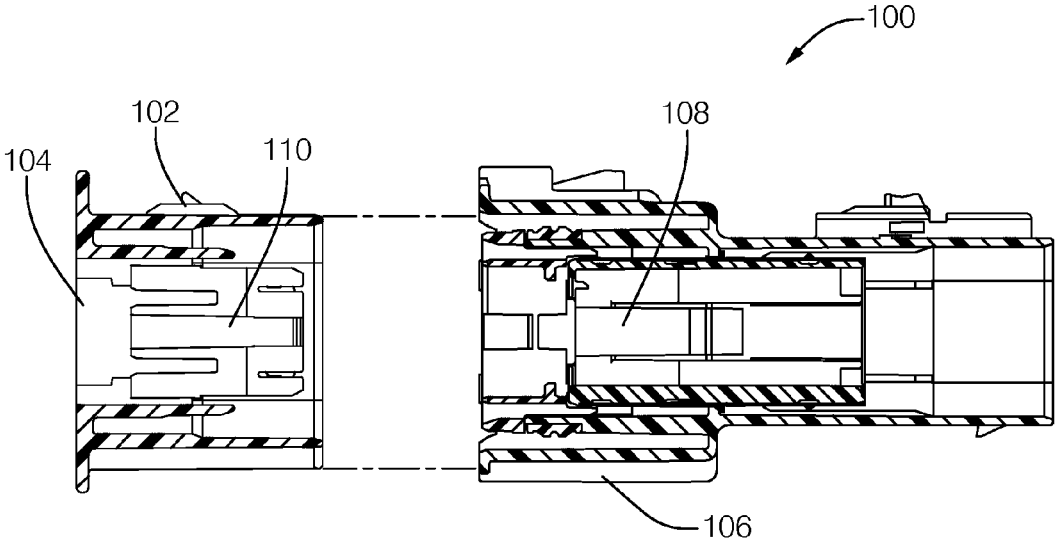
PRIOR ART FIG. 1
FIG. 1 is a cross-sectional view of a prior art connection system prior to mating of a first connection half and a second connection half.
Figure 2:
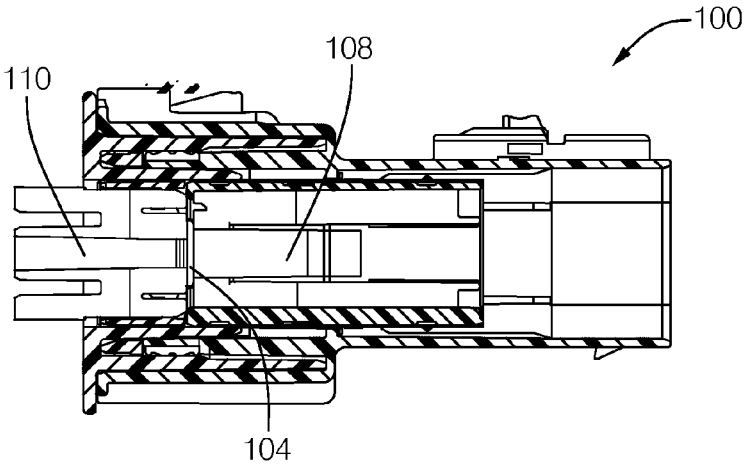
PRIOR ART FIG. 2
FIG. 2 is a cross-sectional view of the prior art connection system of FIG. 1 with the first connection half mated with the second connection half.
Figure 3:
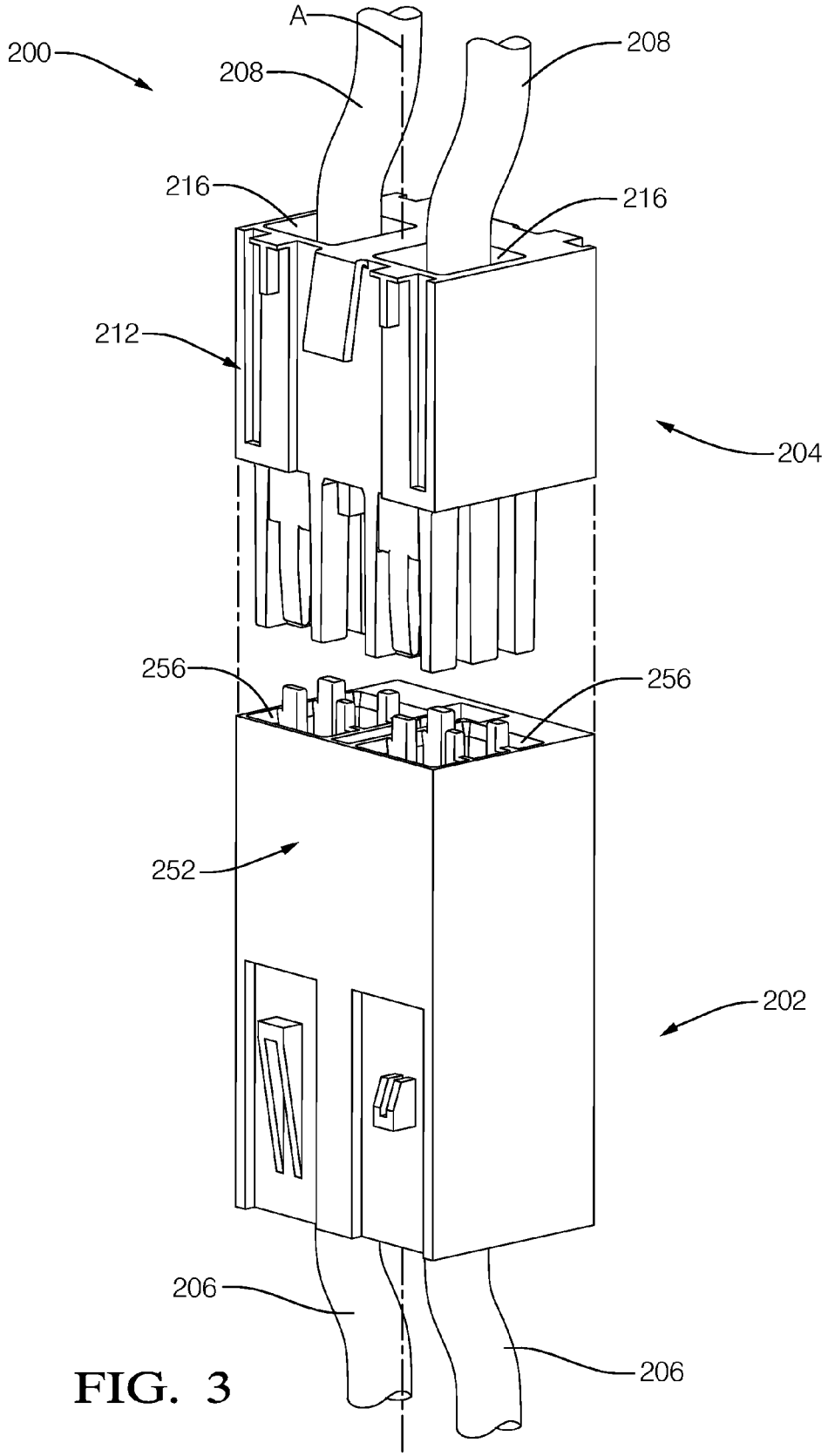
FIG. 3 is an isometric view of an electrical connection assembly in accordance with the invention shown with a male connector unmated with a female connector.
Figure 4:
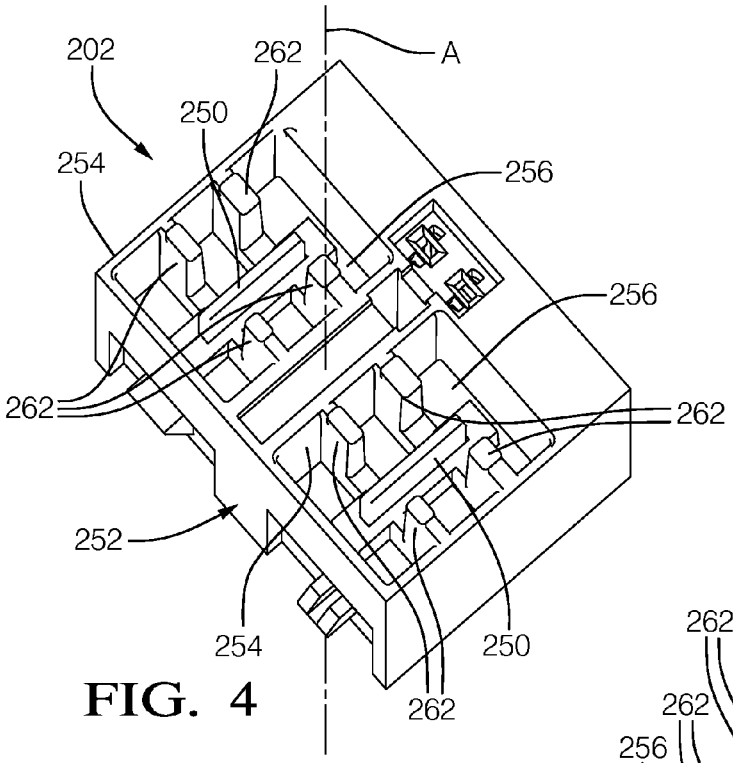
FIG. 4 is an isometric view of the female connector of FIG. 3.

Referring now to FIGS. 3-7 wherein like reference numerals are used to identify identical components in the various views, an electrical connection assembly 200 is shown in accordance with the invention. Electrical connection assembly 200 generally includes a first connector illustrated as a female connector 202 and a mating second connector illustrated as a male connector 204 which mate along a mating axis A. Female connector 202 and male connector 204 are used to electrically connect female connector conductive members 206, illustrated as wires and associated with female connector 202, to male connector conductive members 208, also illustrated as wires and associate with male connector 204. While female connector conductive members 206 and male connector conductive members 208 are illustrated as wires, it should be understood that either or both may take other forms, for example only, such as bus bars or bolt-down terminals. When female connector 202 is mated with male connector 204 along mating axis A, female connector conductive members 206 are placed in electrical communication with male connector conductive members 208, thereby allowing an electrical current and/or an electrical signal to pass between a first device (not shown) connected to female connector conductive members 206 and a second device (not shown) connected to male connector conductive members 208. While two female connector conductive members 206 and two male connector conductive members 208 are shown, it should be understood that any number of female connector conductive members 206 and male connector conductive members 208 may be used.

Male connector 204 includes male connector electrical contacts 210 mounted within a male connector body 212. Each male connector electrical contact 210 is in electrical communication with a respective one of male connector conductive members 208, for example, by crimping, soldering, or other known joining means for connecting electrically conductive bodies. While male connector electrical contacts 210 are illustrated as blade receptacles, it should be understood that other types of electrical contacts may be substituted. Male connector electrical contacts 210 may be formed from any type of material as is known in the connector arts and may be retained within male connector body 212 by press fit, overmolding, or any other manner known in the connector arts.

Male connector body 212 is preferably made of an electrically insulative material, for example plastic, which is formed, for example, during an injection molding process. Male connector body 212 includes a male connector body base 214 having male connector body cavities 216 for individually receiving a portion of male connector electrical contacts 210 therein such that male connector conductive members 208 extend out of male connector body cavities 216. Male connector body cavities 216 may generally extend into male connector body base 214 in the same general direction as mating axis A.

Male connector body 212 also includes male connector body towers 218 extending from male connector body base 214 in the same general direction as mating axis A. Male connector body cavities 216 extend from male connector body base 214 into male connector body towers 218 in order to receive another portion of male connector electrical contacts 210 therein. In this way, male connector electrical contacts 210 are surrounded by male connector body 212. Male connector body towers 218 include male connector slots 220 on an outside surface thereof extending along male connector body towers 218 in the same general direction as mating axis A. Opposing sides of each male connector body tower 218 each include male connector slots 220. Male connector slots 220 may extend from the outside surface of male connector body towers 218 to male connector body cavities 216, however, male connector slots 220 are sufficiently narrow in order to prevent a human finger from entering male connector body cavities 216 sufficiently far so as to come into contact with male connector electrical contacts 210. The end of male connector body towers 218 distal from male connector body base 214 includes male connector body tower apertures 222 extending therethrough in the same direction as mating axis A to provide communication with male connector body cavities 216, however; male connector body tower apertures 222 are sufficiently small in order to prevent a human finger from entering male connector body cavities 216 sufficiently far so as to come into contact with male connector electrical contacts 210. Male connector slots 220 and male connector body tower apertures 222 will be discussed in more detail later.

Female connector 202 includes female connector electrical contacts 250 mounted within a female connector body 252. Each female connector electrical contact 250 is in electrical communication with a respective one of female connector conductive members 206, for example, by crimping, soldering, or other known joining means for connecting electrically conductive bodies. While female connector electrical contacts 250 are illustrated as blade-type terminals, it should be understood that other types of electrical contacts may be substituted that are suitable for mating with male connector electrical contacts 210. Female connector electrical contacts 250 may be formed from any type of material as is known in the connector arts and may be retained within female connector body 252 by press fit, overmolding, or any other manner known in the connector arts.

Female connector body 252 is preferably made of an electrically insulative material, for example plastic, which is formed, for example, during an injection molding process. Each female connector electrical contact 250 is surrounded by a female connector wall 254. Each female connector wall 254 defines a female connector cavity 256 within which one female connector electrical contact 250 is positioned. Female connector cavities 256 each have a bottom end 258 defining a closed end of each female connector cavity 256 and a top end 260 defining an open end of each female connector cavity 256. Female connector electrical contacts 250 may terminate between bottom end 258 and top end 260.

Features of female connector body 252 will now be described which prevent a human finger from entering female connector cavities 256 sufficiently far so as to come into contact with female connector electrical contacts 250 prior to female connector 202 being mated with male connector 204. Female connector ribs 262 extend from female connector walls 254 into female connector cavities 256. Female connector ribs 262 extend the length of female connector cavities 256 in the same direction as mating axis A and may extend outward of female connector cavities 256 beyond top end 260. Female connector ribs 262 of each female connector cavity 256 may preferably be arranged to be on opposing sides of female connector walls 254. Each female connector rib 262 is spaced sufficiently close to every other female connector rib 262 for a given female connector cavity 256 to prevent a human finger from entering female connector cavities 256 sufficiently far so as to come into contact with female connector electrical contacts 250 prior to female connector 202 being mated with male connector 204. Each female connector rib 262 is arranged to fit within a corresponding male connector slot 220 of male connector body 212 when female connector 202 is mated with male connector 204.

Figure 5:
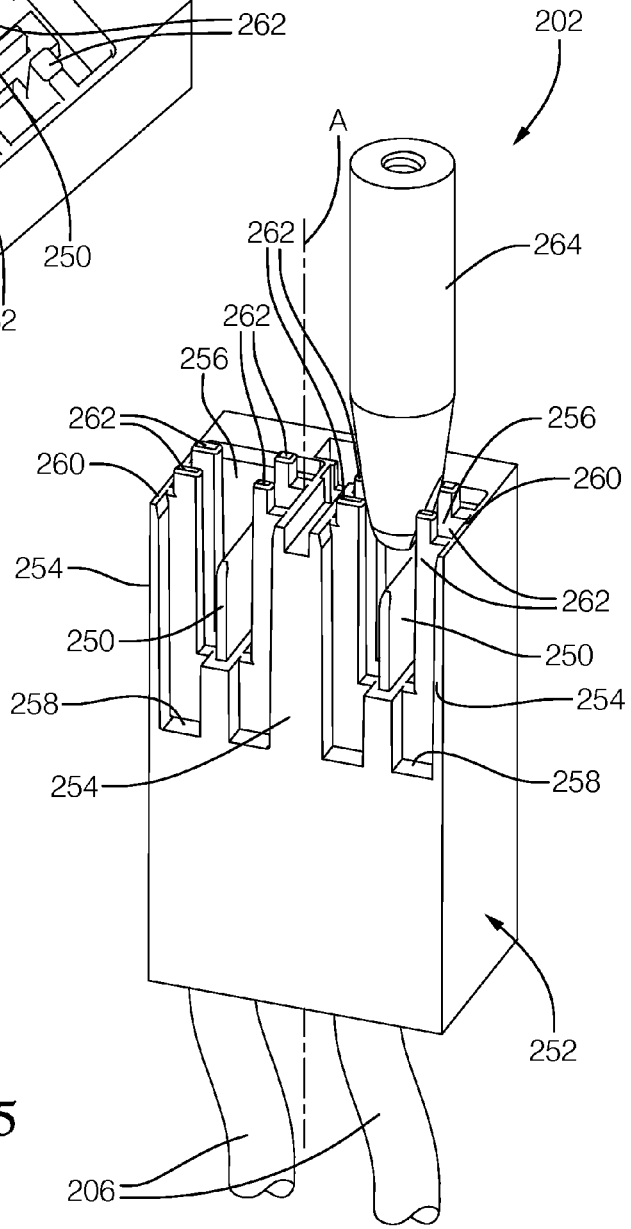
FIG. 5 is an isometric cross-section view of the female connector of FIGS. 3 and 4.
Figure 6:
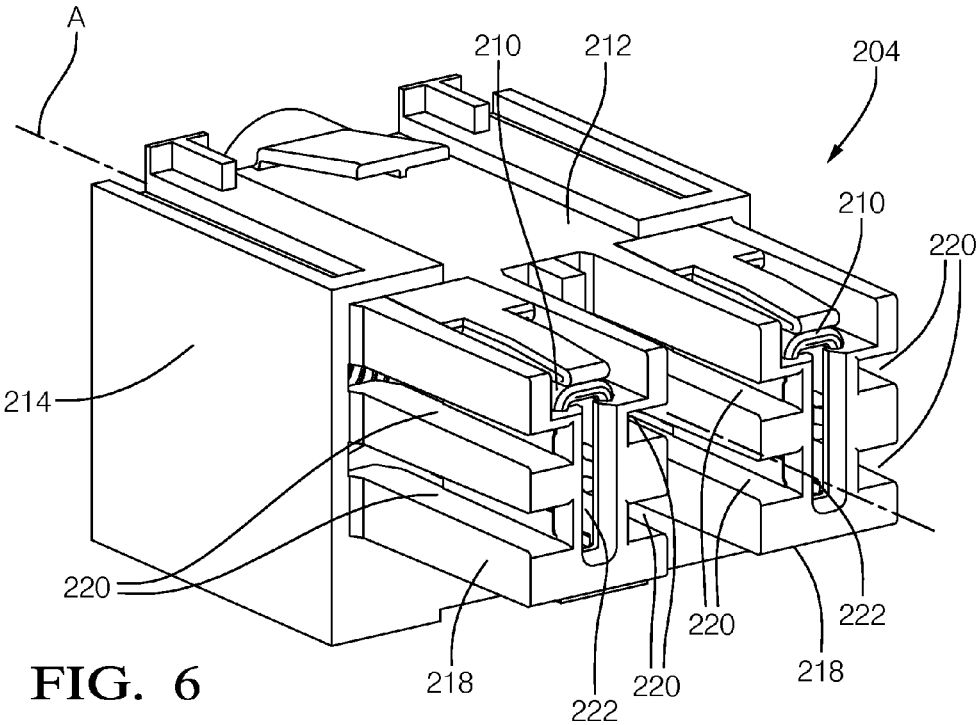
FIG. 6 is an isometric view of the male connector of FIG. 3.

FIG. 5 illustrates a test probe 264, representative of a human finger, which is commonly used to test if a connector is finger proof. As can be seen, female connector ribs 262 prevent test probe 264 from entering female connector cavities 256 sufficiently far so as to come into contact with female connector electrical contacts 250. Female connector ribs 262 and female connector walls 254 preferably have sufficient strength and rigidity to allow a force representative of a human finger, for example seven pounds, to be applied to test probe 264 without allowing test probe 264 from entering female connector cavities 256 sufficiently far so as to come into contact with female connector electrical contacts 250.

Figure 7:
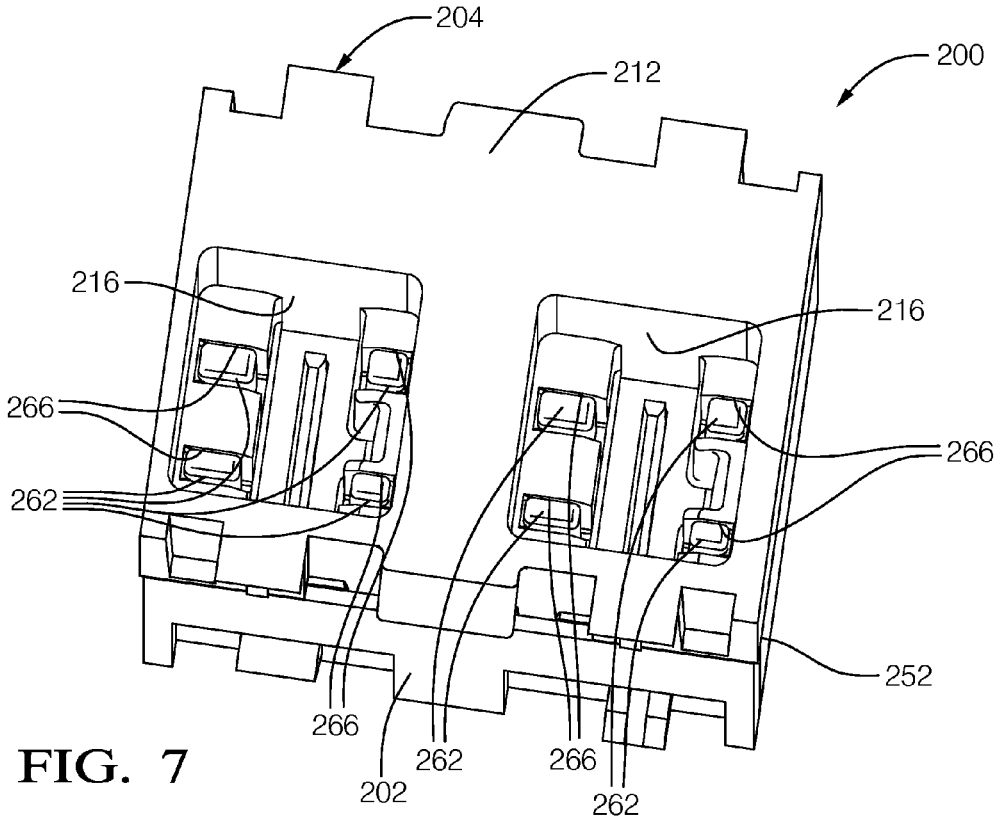
FIG. 7 is an isometric view of the electrical connection assembly of FIG. 3 with the male connector mated with the female connector.
Figure 8:
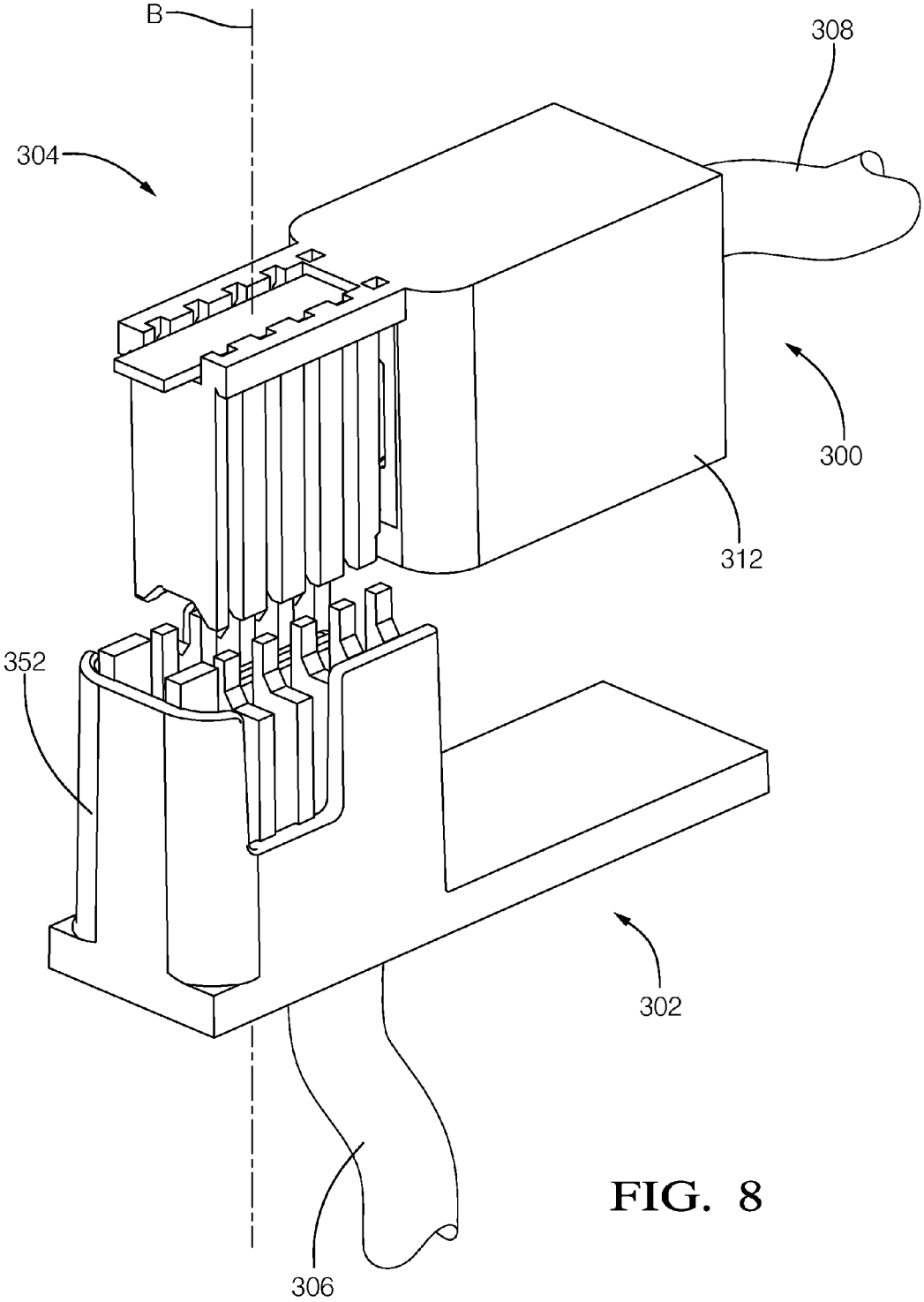
FIG. 8 is an isometric view of a second embodiment of an electrical connection assembly in accordance with the invention shown with a male connector unmated with a female connector.

Female connector 202 is mated with male connector 204 by inserting male connector body towers 218 into female connector cavities 256 along mating axis A. As male connector body towers 218 are inserted into female connector cavities 256, female connector ribs 262 interfit and slide within corresponding male connector slots 220. Similarly, as male connector body towers 218 are inserted into female connector cavities 256, female connector electrical contacts 250 pass through male connector body tower apertures 222 of male connector body towers 218 and male connector electrical contacts 210 are placed into electrical communication with female connector electrical contacts 250. When female connector 202 is fully mated with male connector 204, the portion of female connector ribs 262 that extend outward of female connector cavities 256 beyond top end 260 may be disposed within rib apertures 266 formed in male connector body base 214 as shown in FIG. 7 which allows electrical connection assembly 200 to be more compact in the direction of mating axis A.

Electrical connection assembly 200 is referred to as a straight or inline electrical connection assembly because female connector conductive members 206 exit female connector 202 in the same direction as mating axis A and male connector conductive members 208 exit male connector 204 in the same direction as mating axis A. Reference will now be made to FIGS. 8-11 wherein like reference numerals are used to identify identical components in the various views. An electrical connection assembly 300 is shown in accordance with a second embodiment of the invention wherein electrical connection assembly 300 is referred to as a right angle electrical connection assembly. Electrical connection assembly 300 generally includes a first connector illustrated as a female connector 302 and a mating second connector illustrated as a male connector 304 which mate along a mating axis B. Female connector 302 and male connector 304 are used to electrically connect female connector conductive member 306, illustrated as a wire and associated with female connector 302, to male connector conductive member 308, also illustrated as a wire and associated with male connector 304. While female connector conductive member 306 and male connector conductive member 308 are illustrated as wires, it should be understood that either or both may take other forms, for example only, such as bus bars or bolt-down terminals. When female connector 302 is mated with male connector 304 along mating axis B, female connector conductive member 306 is placed in electrical communication with male connector conductive member 308, thereby allowing an electrical current and/or an electrical signal to pass between a first device (not shown) connected to female connector conductive member 306 and a second device (not shown) connected to male connector conductive member 308. While one female connector conductive member 306 and one male connector conductive member 308 are shown, it should be understood that any number of female connector conductive members 306 and male connector conductive members 308 may be used.

Male connector 304 includes a male connector electrical contact 310 mounted within a male connector body 312. Male connector electrical contact 310 is in electrical communication with male connector conductive member 308, for example, by crimping, soldering, or other known joining means for connecting electrically conductive bodies. While male connector electrical contact 310 is illustrated as a blade receptacle, it should be understood that other types of electrical contacts may be substituted. Male connector electrical contact 310 may be formed from any type of material as is known in the connector arts and may be retained within male connector body 312 by press fit, overmolding, or any other manner known in the connector arts.

Male connector body 312 is preferably made of an electrically insulative material, for example plastic, which is formed, for example, during an injection molding process. Male connector body 312 includes a male connector body cavity 316 with male connector electrical contact 310 therein such that male connector conductive member 308 extends out of male connector body cavity 316 in a direction substantially perpendicular to mating axis B. In this way, male connector electrical contact 310 is surrounded by male connector body 312.

Male connector body 312 includes male connector slots 320 on an outside surface thereof extending along male connector body 312 in the same general direction as mating axis B. Opposing sides of male connector body 312 each include male connector slots 320. Male connector slots 320 may extend from the outside surface of male connector body 312 to male connector body cavity 316; however, male connector slots 320 are sufficiently narrow in order to prevent a human finger from entering male connector body cavity 316 sufficiently far so as to come into contact with male connector electrical contact 310. One end of male connector body 312 includes a male connector body aperture 322 extending therethrough in the same direction as mating axis B to provide communication with male connector body cavity 316, however male connector body aperture 322 is sufficiently small in order to prevent a human finger from entering male connector body cavity 316 sufficiently far so as to come into contact with male connector electrical contacts 310. Male connector slots 320 and male connector body aperture 322 will be discussed in more detail later.

Female connector 302 includes female connector electrical contact 350 mounted within a female connector body 352. Female connector electrical contact 350 is in electrical communication with female connector conductive member 306, for example, by crimping, soldering, or other known joining means for connecting electrically conductive bodies. While female connector electrical contact 350 is illustrated as a blade-type terminal, it should be understood that other types of electrical contacts may be substituted that are suitable for mating with male connector electrical contact 310. Female connector electrical contact 350 may be formed from any type of material as is known in the connector arts and may be retained within female connector body 352 by press fit, overmolding, or any other manner known in the connector arts.

Female connector body 352 is preferably made of an electrically insulative material, for example plastic, which is formed, for example, during an injection molding process. Female connector electrical contact 350 is surrounded by a female connector wall 354. Female connector wall 354 defines a female connector cavity 356 within which female connector electrical contact 350 is positioned. Female connector wall 354 includes a discontinuity defining a passage 355 through female connector wall 354 to allow male connector electrical contact 310 and/or male connector conductive member 308 to pass therethrough when female connector 302 is mated with male connector 304. Passage 355 is sufficiently narrow in order to prevent a human finger from entering male connector body cavity 316 through passage 355 sufficiently far so as to come into contact with male connector electrical contacts 310. Female connector cavity 356 has a bottom end 358 defining a closed end of female connector cavity 356 and a top end 360 defining an open end of female connector cavity 356. Female connector electrical contact 350 may terminate between bottom end 358 and top end 360.

Features of female connector body 352 will now be described which prevent a human finger from entering female connector cavity 356 sufficiently far so as to come into contact with female connector electrical contact 350 prior to female connector 302 being mated with male connector 304. Female connector ribs 362 extend from female connector wall 354 into female connector cavity 356. Female connector ribs 362 extend the length of female connector cavity 356 in the same direction as mating axis B and may extend outward of female connector cavity 356 beyond top end 360. Female connector ribs 362 of female connector cavity 356 may preferably be arranged to be on opposing sides of female connector wall 354. Each female connector rib 362 is spaced sufficiently close to every other female connector rib 362 to prevent a human finger from entering female connector cavity 356 sufficiently far so as to come into contact with female connector electrical contact 350 prior to female connector 302 being mated with male connector 304. Each female connector rib 362 is arranged to fit within a corresponding male connector slot 320 of male connector body 312 when female connector 302 is mated with male connector 304.

Figure 10:
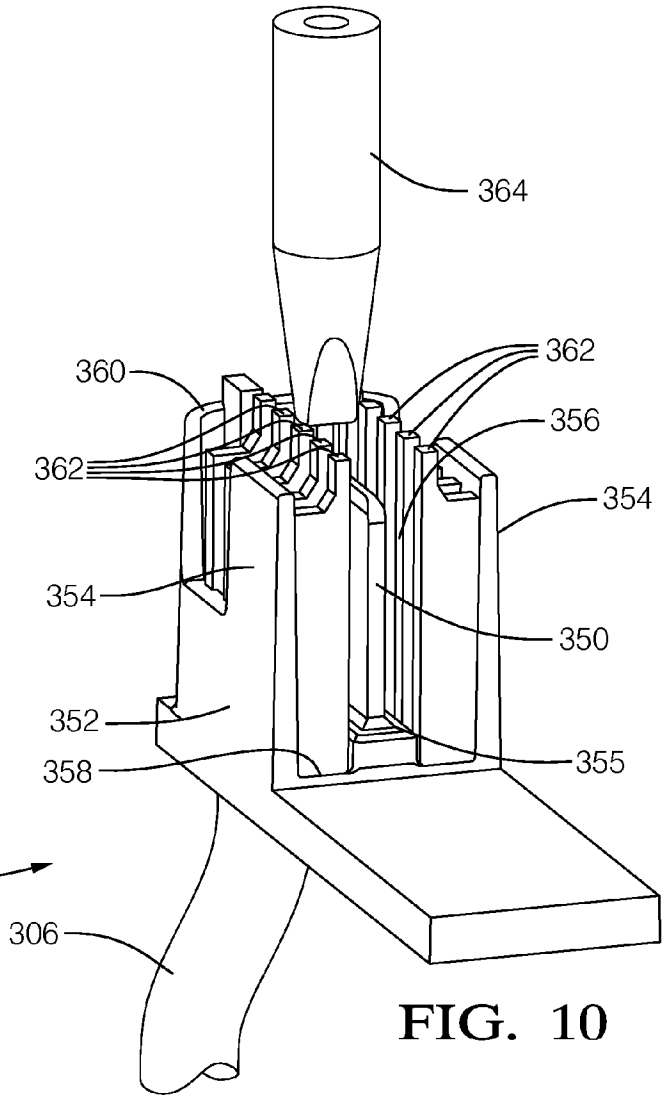
FIG. 10 is an isometric view of the female connector of FIG. 8.
Figure 9:
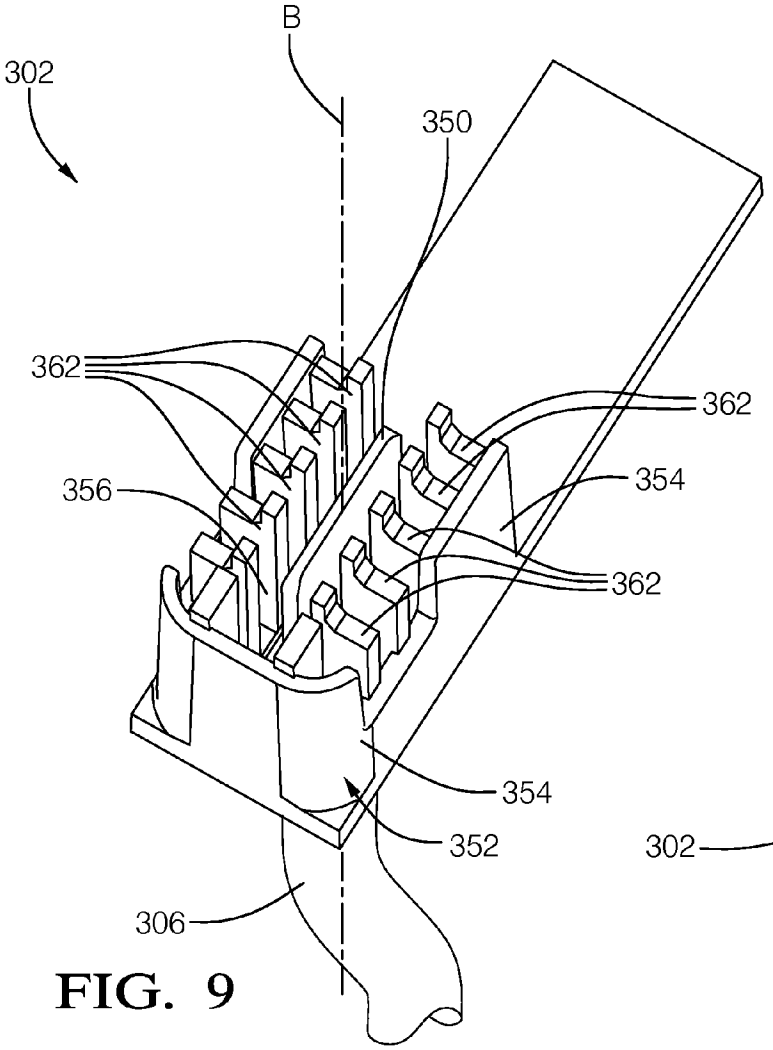
FIG. 9 is an isometric view of the female connector of FIG. 8.
Figure 11:
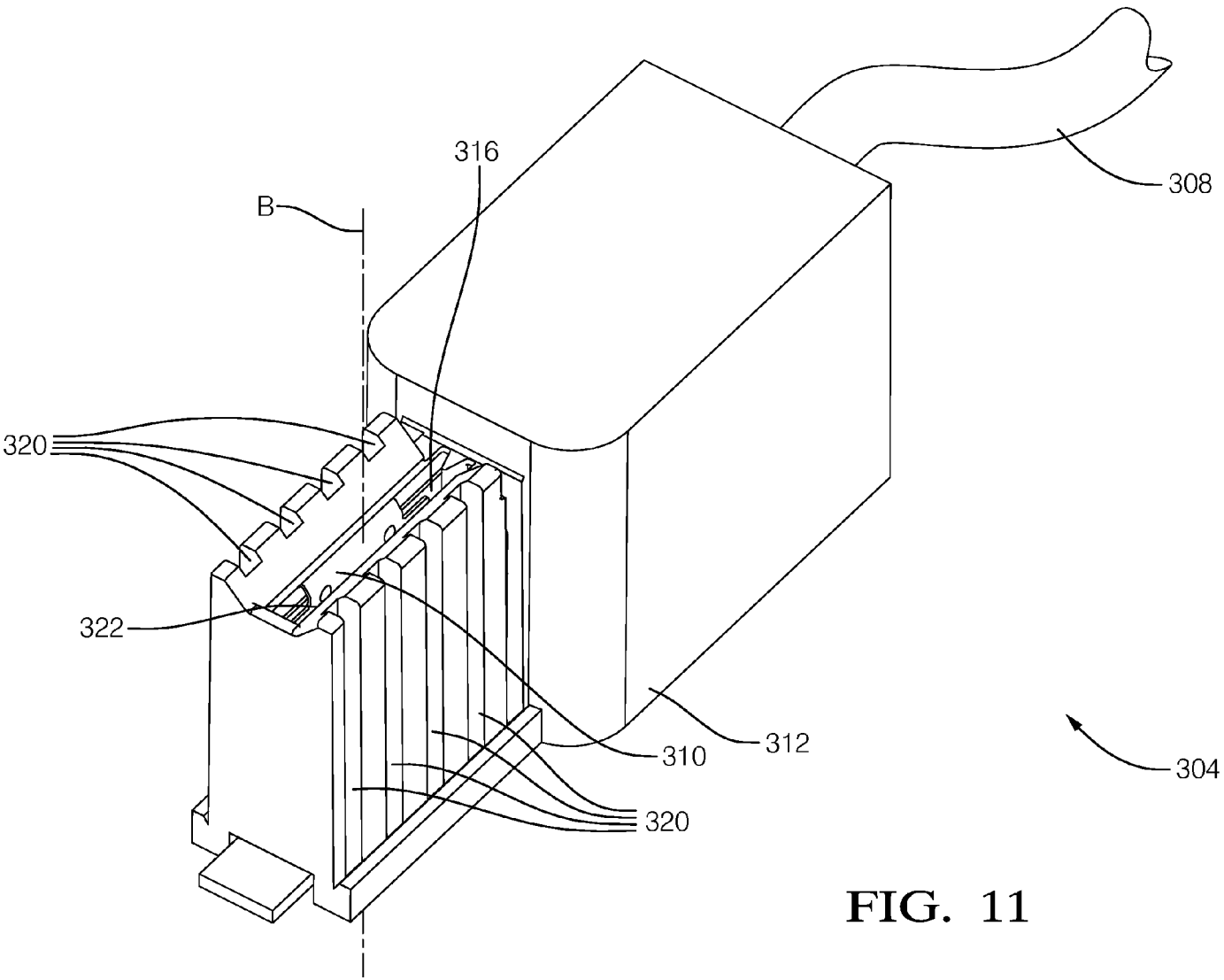
FIG. 11 is an isometric view of the male connector of FIG. 8.

FIG. 10 illustrates a test probe 364, representative of a human finger, which is commonly used to test if a connector is finger proof. As can be seen, female connector ribs 362 prevent test probe 364 from entering female connector cavity 356 sufficiently far so as to come into contact with female connector electrical contact 350. Female connector ribs 362 and female connector wall 354 preferably have sufficient strength and rigidity to allow a force representative of a human finger, for example seven pounds, to be applied to test probe 364 without allowing test probe 364 from entering female connector cavity 356 sufficiently far so as to come into contact with female connector electrical contact 350.

Female connector 302 is mated with male connector 304 by inserting a portion of male connector body 312 into female connector cavity 356 along mating axis B. As male connector body 312 is inserted into female connector cavity 356, female connector ribs 362 interfit and slide within corresponding male connector slots 320. Similarly, as male connector body 312 are inserted into female connector cavity 356, female connector electrical contact 350 pass through male connector body aperture 322 of male connector body 312 and male connector electrical contact 310 is placed into electrical communication with female connector electrical contact 350. Male connector electrical contact 310 and/or male connector conductive member 308 pass through passage 355 of female connector 302 while female connector 302 is being mated with male connector 304 and when female connector 302 is fully mated with male connector 304.

Electrical connection assemblies 200, 300 may be particularly useful for electric vehicles and hybrid electric vehicles which commonly employ voltages of 60 V or greater. Since electrical connection assemblies 200, 300 do not utilize moving parts to protect the electrical contacts, electrical connection assemblies 200, 300 may be reliable over the entire service live of the vehicle. Electrical connection assemblies 200, 300 may also be particularly useful in wiring of structures, such as homes, offices, and business where building codes need to be adhered to. While electrical connection assemblies 200, 300 may be particularly useful in systems which have voltages greater than or equal to 60 V, it should be understood that electrical connection assemblies 200, 300 may also find utility in systems that experience voltages below 60 V including both direct current and alternating current.

While this invention has been described in terms of preferred embodiments thereof, it is not intended to be so limited, but rather only to the extent set forth in the claims that follow.

We claim:

1. An electrical connection assembly comprising:

a first connector including a first electrical contact surrounded by a first connector wall defining a first connector cavity, said first connector wall having a plurality of ribs extending into said first connector cavity; and a second connector matable with said first connector along a mating axis and having a second electrical contact in electrical communication with said first electrical contact when said first connector is mated with said second connector, said second connector having a second connector body surrounding said second electrical contact and having a plurality of slots corresponding to said plurality of ribs such that each of said plurality of ribs of said first connector fits within a respective slot of said second connector when said second connector is mated with said first connector wherein said first connector cavity has a bottom defining a closed end of said first connector cavity and a top defining an open end of said first connector cavity, wherein said plurality of ribs extend outward of said first connector cavity beyond said open end.

2. An electrical connection assembly as in claim 1 wherein said first electrical contact terminates between said bottom and said top.

3. An electrical connection assembly as in claim 1, wherein said plurality of ribs extend outward of said first connector cavity beyond said open end and through corresponding rib apertures of said second connector body when said second connector is mated with said first connector.

4. An electrical connection assembly as in claim 1, wherein said first connector wall has a discontinuity defining a passage through said first connector wall whereby said second connector body is disposed within said passage when said second connector is mated with said first connector.

5. An electrical connection assembly as in claim 1 wherein a portion of said second connector body surrounds a portion of said first electrical contact when said second connector is mated with said first connector.

6. An electrical connection assembly as in claim 1 wherein said first connector wall surrounds a portion of said second connector body when said second connector is mated with said first connector.

7. An electrical connection assembly as in claim 1, wherein said first connector wall has opposing wall sides and each of said opposing wall sides includes at least one of said plurality of ribs.

8. An electrical connection assembly as in claim 7, wherein each of said opposing wall sides includes at least two of said plurality of ribs.

9. An electrical connection assembly as in claim 7, wherein a portion of said second connector body is positioned between said opposing wall sides which each include at least one of said plurality of ribs.

10. An electrical connection assembly as in claim 7, wherein said second connector body has opposing sides and each of said opposing sides includes at least one of said plurality of slots.

11. An electrical connection assembly as in claim 10, wherein each of said opposing sides includes at least two of said plurality of slots.

12. An electrical connection assembly comprising:

a first connector including a first electrical contact surrounded by a first connector wall defining a first connector cavity, said first connector wall having a plurality of ribs extending into said first connector cavity; and a second connector matable with said first connector along a mating axis and having a second electrical contact in electrical communication with said first electrical contact when said first connector is mated with said second connector, said second connector having a second connector body surrounding said second electrical contact;

wherein said first connector cavity has a bottom defining a closed end of said first connector cavity and a top defining an open end of said first connector cavity; and wherein said plurality of ribs extend outward of said first connector cavity beyond said open end.

13. An electrical connection assembly comprising:

a first connector including a first electrical contact surrounded by a first connector wall defining a first connector cavity, said first connector wall having a plurality of ribs extending into said first connector cavity; and a second connector matable with said first connector along a mating axis and having a second electrical contact in electrical communication with said first electrical contact when said first connector is mated with said second connector, said second connector having a second connector body surrounding said second electrical contact;

wherein said first connector cavity has a bottom defining a closed end of said first connector cavity and a top defining an open end of said first connector cavity; and wherein said plurality of ribs extend outward of said first connector cavity beyond said open end and through corresponding rib apertures of said second connector body when said second connector is mated with said first connector.

* * * * *